United States Patent [19]

Best

[11] Patent Number: 4,837,411

[45] Date of Patent: Jun. 6, 1989

[54] SPRING SWITCH

[75] Inventor: Gary R. Best, Hamilton, Ill.

[73] Assignee: Methode Electronics, Inc., Chicago, Ill.

[21] Appl. No.: 129,299

[22] Filed: Dec. 7, 1987

[51] Int. Cl.[4] ..... H01H 3/12

[52] U.S. Cl. ..... 200/5 A; 200/61.54; 200/345

[58] Field of Search ..... 200/335, 339, 61.54, 200/5 A, 159 B, 241, 242, 67 D, 5 R, 159 A, 83 N, 159 R

[56] References Cited

U.S. PATENT DOCUMENTS

| | | | |
|---|---|---|---|
| 4,145,588 | 3/1979 | Orcutt | 200/83 N |
| 4,245,139 | 1/1981 | Orscheln et al. | 200/52 R |
| 4,352,963 | 10/1982 | De Philippis et al. | 200/5 A |
| 4,436,970 | 3/1984 | Swisher | 200/61.56 |
| 4,438,304 | 3/1984 | Kennedy | 200/67 D |
| 4,471,182 | 9/1984 | Wielgos et al. | 200/83 P |

FOREIGN PATENT DOCUMENTS

| | | | |
|---|---|---|---|
| 958754 | 5/1964 | United Kingdom | 200/67 D |

*Primary Examiner*—A. D. Pellinen
*Assistant Examiner*—Morris Ginsburg
*Attorney, Agent, or Firm*—Allegretti & Witcoff, Ltd.

[57] ABSTRACT

An electrical switch assembly comprises a first, domed, flexible contact member plus at least one second, flexible, finger-type contact member positioned under the first contact member in normally spaced relation thereto. Actuator means are provided for pressing the first, domed contact member into contact with the second contact member to actuate the switch assembly. In accordance with this invention the second, flexible, finger-type contact member defines an end portion which is bent to permit increased-area contact with the first contact member when the first contact member is pressed into contact with the second contact member. This also provides improved wiping action between the first and second contacts as the increased-area contact is made and broken for removal of carbon build-up and the like.

4 Claims, 1 Drawing Sheet

SPRING SWITCH

BACKGROUND OF THE INVENTION

In Swisher U.S. Pat. No. 4,436,970 a switch assembly is disclosed in which a domed, flexible contact member may be pressed into contact with an upwardly projecting, flexible finger-type contact member. This type of structure has exhibited numerous advantages in convenience of manufacture and utility in the field of small switches, for example switches for use in the automotive field., In accordance with this invention, improvements are provided to the structure described in the Swisher patent. Specifically, by the improvement of this invention, an increased amount of contact area may be provided between the domed contact ember and the finger-type contact member, permitting higher current flow through the switch. Other advantages as well are achieved by the improvement of this invention.

DESCRIPTION OF THE INVENTION

In this invention, an electrical switch assembly is disclosed which comprises a first, domed, flexible contact member. At least one second, flexible, finger-type contact member is positioned under the first contact member in normally spaced relation thereto. Actuator means are provided for pressing the first, domed contact member into contact with the second, flexible contact member.

By the improvement of this invention, the second, flexible, finger-type contact member defines an end portion which is bent, preferably as a curved portion, although an angular bend may also be used, to permit increased-area contact with the first contact member, when the first contact member is pressed into contact with the second contact member. Additionally, this also provides improved wiping action between the first and second contact members as the increased-area contact is made and broken.

Preferably, a pair of spaced, second, flexible finger-type contact members, having the bent end portions as described above, are positioned under the first contact member for intermittent contact therewith though pressing by the actuator means. The pair of contact members may be each electrically connected to half of an electric circuit, so that when the first, flexible contact member is brought into contact with both of the second contact members, the electric circuit is closed. Thus, the first, domed contact member may be a passive circuit portion which is not electrically connected to the circuit except by entering into contact with the two second contact members. Alternatively, the first contact member may be connected to an electrical circuit, if desired.

The electrical switch assembly is self springing, with the natural resilience of the dome tending to force itself and the actuator means outwardly, thus breaking contact in the switch assembly.

A wider area of contact is thus formed between the first, domed contact and each of the second, flexible, finger-type contact members than is found in the prior art structures. This, in turn, permits the transmission of greater electrical currents through the switch of this invention. Also, the specific structure of this invention provides improved wiping action between the first and second contact members as the increased-area contact is made and broken. This facilitates in removal of carbon and other undesirable substances building up on the contact members to interfere with electrical transmission between them.

The switch of this invention may be used in a variety of ways, particularly in the automotive field. Specifically, it is contemplated for use as an automobile door lock switch, mounted on the inside door of new automobile models.

DESCRIPTION OF SPECIFIC EMBODIMENT

Figure 1:
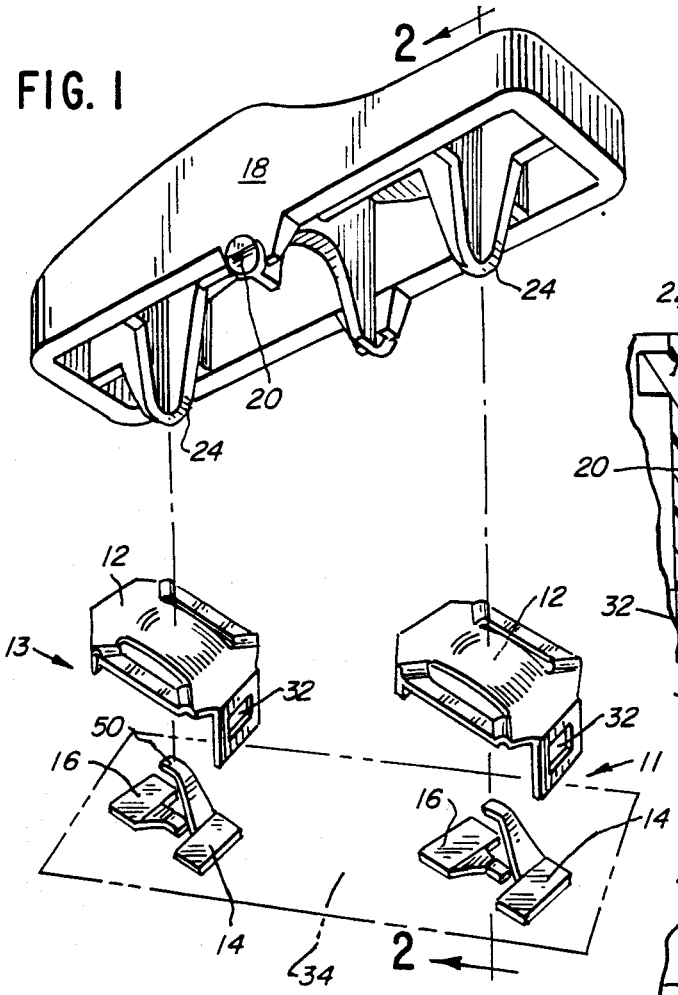
FIG. 1 is an exploded view of a portion of the improved switch of this invention.

Referring to the drawings, switch assembly 10 is shown as an automotive door lock. The switch assembly constitutes two switch units 11, 13, each of which comprises a first, domed, flexible contact member 12 and a pair of second, flexible finger-type contact members 14, 16 which interact with domed contact member 12. It can be seen in FIG. 1 that a pair of such switch assemblies are provided, both of them being operated by a single actuator member 18.

Each of contact members 16 may be connected to an electric power source. Contact member 18 of switch unit 11 may be connected to an unlocking circuit, while contact member 18 of switch unit 13 may be connected to a locking circuit.

Figure 2A:
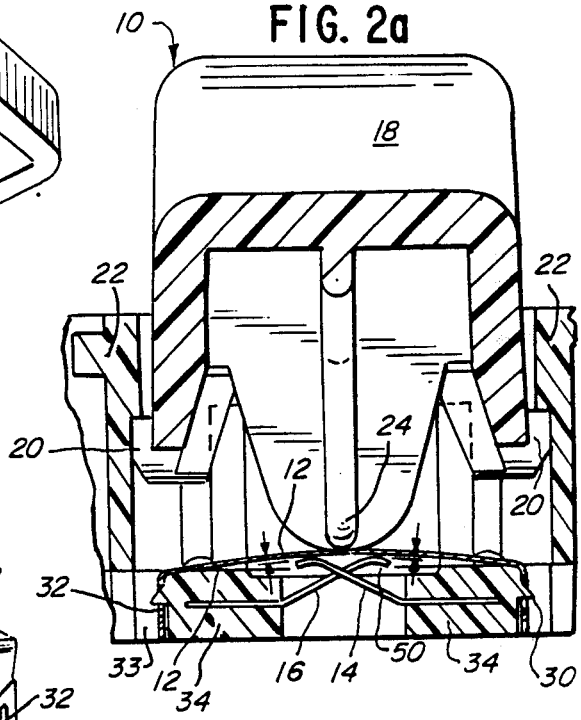
FIG. 2*a* is a transverse sectional view taken along line 2—2 of FIG. 1, showing the switch in its open position.

As shown in FIG. 2*a*, in its normal configuration, in each switch unit, first, domed, contact member 12 is positioned above second contact members 14, 16, which are out of contact with each other, and both slightly spaced from first, domed contact member 12. Actuator member 18 is shown to be pivotally mounted by a journal 20 which is molded integrally with the rest of actuator member 18. Journal 20 rotates, and snaps into journal box walls 22, which are molded integrally with base 34. Actuator member 18 may thus be pivoted back and forth to cause actuator fingers 24 to respectively and alternatingly depress the domed first contact 12 against which the particular actuator finger 24 rests. When this takes place, actuator finger 24 and domed first contact 12 may be advanced so that first contact 12 enters into electrical connection with second contacts 14, 16. Thus, the switch assembly is used to respectively and alternatingly open and close switch units 11, 13.

Figure 2B:
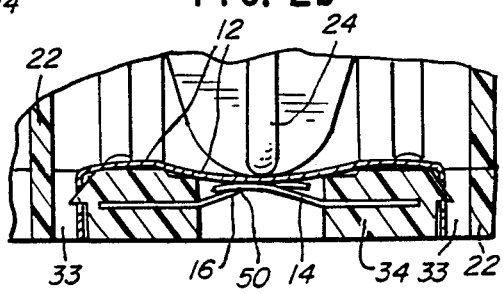
FIG. 2*b* is a sectional view similar to that of FIG. 2*a* showing the switch in closed position.

Each actuator finger 24 can be seen to be molded integrally with the rest of actuator member 18 to form a single piece. First, domed contact member 12 may be a stamped and stretched piece of conductive metal made in accordance with the teachings of the previously cited Swisher U.S. Pat. No. 4,436,970. As shown in FIGS. 2*a* and 2*b*, each first contact member 12 may be retained by the action of snap-fit detent member 30 which projects through each of a pair of apertures 32 in first contact member 12 and into a slot 33, defined by plastic base 34. Second contact members 14, 16 of each switch unit 11, 13 may be insert molded into base 34 for retention thereof, with detent member 30 defined by plastic base 34, which is integral with support walls 22.

Figure 3:
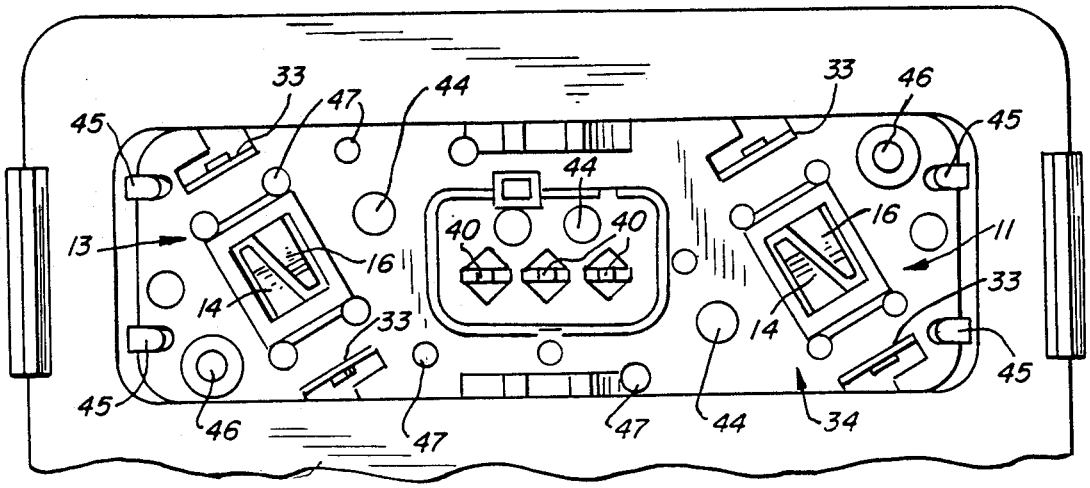
FIG. 3 is a plan view, with parts broken away, showing the interior of the switch of FIG. 1.

FIG. 3 shows a top plan view of one embodiment of the switch in accordance with this invention with the top housing, actuator, and switch units 11, 13 removed. Second contact members 14, 16 can be seen in their mounted position on base 34. Three electrical connector prongs 40 may also be seen. Holes 44 are provided in the plastic base 34 to create separate circuits for members 14 and 16 in the case where members 14 and 16 are molded into base 34 as part of a single, integral conductive metal strip and then later electrically isolated from each other by said holes 44.

Actuator stop pads 45 are provided to limit the downward travel of fingers 24 to prevent damage to contact members 12. Holes 46 are provided in the remnants of the integral metal circuit sheet that constitutes fingers 14, 16, to receive pins from the molding tool for orientation during the molding process. Holes 47 (15 in all) are provided in the base to receive pins to press the flat integral metal circuit strip in its desired location during the molding process.

In accordance with this invention, each of second contact members 14, 16 define a curved end portion 50 for the purpose of providing increased-area contact with first contact member 12 when pressed into contact therewith as in FIG. 2*b*. Additionally, as stated above, improved wiping action between the respective first and second contact members can be provided in this manner as the increased-area contact is made and broken.

Apart from the above, the spring switch of this invention may be made in accordance with conventional technology.

Accordingly, an improved switch assembly is shown which exhibits the advantages as described above. The above has been offered for illustrative purposes only, and is not intended to limit the scope of the invention of this application, which is as defined in the claims below.

That which is claimed is:

1. In an electrical switch assembly which comprises a first, outwardly doomed, flexible contact member, and a pair of spaced, second, flexible, finger-type contact members positioned under said first contact member in normally spaced relation thereto, and actuator means for pressing said first domed contact member into contact with said second, flexible contact members by collapsing said domed member, said second, flexible finger-type contact members each defining an end portion which is bent to permit increased area contact with said first contact member when said first contact member is pressed into contact therewith, while providing improved wiping action between the first and second contact members as said increased-area contact is made and broken.

2. The switch assembly of claim 1 in which the bent ends of said second contact members each define a curved portion.

3. In an electrical switch assembly which comprises a first, outwardly domed, flexible contact member, second, flexible, finger-type contact member means positioned under said first contact member in normally spaced relation thereto, and actuator means for pressing said first, domed contact member into contact with said second, flexible contact member means by collapsing said domed member, the improvement comprising, in combination:

said second contact member means comprising a pair of second, flexible, finger-type contact members positioned under said first contact member for contact therewith through pressing by said actuator means, each second, flexible contact member defining an end portion which is bent to permit increased-area contact with said first contact member when said first contact member is pressed into contact therewtih, while providing improved wiping action between the first and second contact members as said increased-area contact is made and broken, the bent ends of said second contact members each defining a curved portion.

4. In an electrical switch assembly which comprises a first, outwardly domed contact member; a pair of second, flexible, finger-type contact members positioned under said first contact member in normally spaced relation thereto and actuator means for pressing said first, domed contact member into contact with said second, flexible contact members by collapsing said domed member, whereby an electrical circuit comprising said pair of second contact members may be closed by said contact with the first, domed contact member.

* * * * *